US010450112B2

(12) United States Patent
Cimmerer et al.

(10) Patent No.: US 10,450,112 B2
(45) Date of Patent: Oct. 22, 2019

(54) TAMPER EVIDENT PLASTIC FOOD CONTAINER

(71) Applicant: Anchor Packaging, Inc., St. Louis, MO (US)

(72) Inventors: Tim Cimmerer, Paragould, AR (US); Kevin R. Krueger, Fenton, MO (US); Mike Pohlman, Valley Park, MO (US)

(73) Assignee: Anchor Packaging, LLC, St. Louis, MO (US)

( * ) Notice: Subject to any disclaimer, the term of this patent is extended or adjusted under 35 U.S.C. 154(b) by 85 days.

(21) Appl. No.: 15/790,285

(22) Filed: Oct. 23, 2017

(65) Prior Publication Data

US 2018/0057223 A1 Mar. 1, 2018

Related U.S. Application Data

(63) Continuation of application No. 14/788,024, filed on Jun. 30, 2015, now Pat. No. 9,796,511.

(51) Int. Cl.
*B65D 41/32* (2006.01)
*B65D 43/26* (2006.01)
(Continued)

(52) U.S. Cl.
CPC ..... *B65D 43/26* (2013.01); *B65D 17/404* (2018.01); *B65D 43/162* (2013.01); *B65D 2101/00* (2013.01); *B65D 2101/0092* (2013.01); *B65D 2543/00101* (2013.01); *B65D 2543/00296* (2013.01); *B65D 2543/00324* (2013.01); *B65D 2543/00509* (2013.01); *B65D 2543/00833* (2013.01)

(58) Field of Classification Search
CPC ..... B65D 17/165; B65D 2543/00842; B65D 2543/00907; B65D 43/162; B65D 2543/00324; B65D 2101/0092; B65D 17/40
USPC ..... 220/270
See application file for complete search history.

(56) References Cited

U.S. PATENT DOCUMENTS 4,128,808 A 12/1978 Westra
5,242,696 A 9/1993 McDevitt
(Continued)

FOREIGN PATENT DOCUMENTS

EP 1695919 8/2006
EP 2210819 6/2012
(Continued)

*Primary Examiner* — Mollie Impink
(74) *Attorney, Agent, or Firm* — Don V. Kelly; Evans & Dixon, L.L.C.

(57) ABSTRACT

A tamper evident container comprises a lid and a base. The lid includes a lid rim having a lid rim flange. The base includes a base rim having a base rim flange. A frangible hinge is formed between a top pinch segment peripherally projecting from the lid rim flange and a bottom pinch segment peripherally projecting from the base rim flange. The frangible hinge is configured to rupture when the container is in the initially sealed arrangement by the application of a pinching force to the top pinch segment and bottom pinch segment that results in the relative vertical movement of the segments toward each other. As compared to the prior art, the container hinges about a frangible vertex instead of hinging about a square-shaped structure.

7 Claims, 15 Drawing Sheets

(51) Int. Cl.
*B65D 43/16* (2006.01)
*B65D 17/28* (2006.01)

(56) References Cited

U.S. PATENT DOCUMENTS

| | | | | |
|---|---|---|---|---|
| 5,897,011 | A | 4/1999 | Brilliant | |
| 6,135,304 | A | 10/2000 | Wyslotsky | |
| 6,572,909 | B1 | 6/2003 | Bagwell et al. | |
| 7,073,680 | B2 | 7/2006 | Boback et al. | |
| 7,118,003 | B2 | 10/2006 | Sellari et al. | |
| 7,246,714 | B2 | 7/2007 | Garg et al. | |
| D587,993 | S | 3/2009 | Vovan | |
| 7,568,589 | B2 | 8/2009 | Vovan | |
| 7,631,776 | B2 | 12/2009 | Vovan | |
| 7,685,677 | B2 | 3/2010 | Garg et al. | |
| 7,712,626 | B2 | 5/2010 | Vovan | |
| 7,992,743 | B2 | 8/2011 | Vovan | |
| 8,056,750 | B2 | 11/2011 | Vovan | |
| 8,083,089 | B2 | 12/2011 | Vovan | |
| 8,123,064 | B2 | 2/2012 | Vovan | |
| 8,251,249 | B1 | 8/2012 | Vovan | |
| 8,371,468 | B2 | 2/2013 | Sellari et al. | |
| D693,672 | S | 11/2013 | Bontrager et al. | |
| 8,608,008 | B2 | 12/2013 | Gingras et al. | |
| D698,241 | S | 1/2014 | Fosse | |
| 8,672,166 | B2 | 3/2014 | Nazareth et al. | |
| 8,757,416 | B2 * | 6/2014 | Golota ..... | B65D 43/0249 220/276 |
| 8,795,580 | B2 | 8/2014 | Sellari et al. | |
| 8,833,589 | B2 | 9/2014 | Vovan | |
| 8,851,315 | B2 | 10/2014 | Vovan | |
| 8,938,307 | B2 | 1/2015 | Gingras | |
| 9,016,503 | B2 | 4/2015 | Barbier | |
| 9,580,219 | B2 | 2/2017 | Cimmerer et al. | |
| 9,656,785 | B2 | 5/2017 | Cimmerer et al. | |
| 9,796,511 | B2 | 10/2017 | Cimmerer et al. | |
| 2004/0118848 | A1 | 6/2004 | Marshall | |
| 2007/0045317 | A1 | 3/2007 | Rosender | |
| 2008/0023471 | A1 | 1/2008 | Garg et al. | |
| 2008/0308557 | A1 | 12/2008 | Kyle et al. | |
| 2009/0090712 | A1 | 4/2009 | Vovan et al. | |
| 2010/0072217 | A1 | 3/2010 | Parikh et al. | |
| 2010/0102074 | A1 | 4/2010 | Parikh et al. | |
| 2010/0181323 | A1 | 7/2010 | Thaler | |
| 2011/0000929 | A1 | 1/2011 | Brown et al. | |
| 2012/0067009 | A1 | 3/2012 | Bontrager et al. | |
| 2012/0181280 | A1 | 7/2012 | Barbier | |
| 2013/0175280 | A1 | 7/2013 | Stodd | |
| 2014/0069922 | A1 | 3/2014 | Boback et al. | |
| 2016/0185490 | A1 | 6/2016 | Wang | |

FOREIGN PATENT DOCUMENTS

| | | |
|---|---|---|
| EP | 2580138 | 4/2014 |
| WO | WO2003022703 | 3/2003 |
| WO | WO2005009857 | 2/2005 |
| WO | WO2005056414 | 6/2005 |
| WO | WO2006119538 | 11/2006 |
| WO | WO2008008343 | 1/2008 |

* cited by examiner

TAMPER EVIDENT PLASTIC FOOD CONTAINER

CROSS REFERENCE TO RELATED APPLICATION

This application is a continuation application and claims the benefit of Ser. No. 14/788,024 which was filed on Jun. 30, 2015, and issued Oct. 24, 2017 as U.S. Pat. No. 9,796,511.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to plastic food containers. The invention is more specifically related to resealable plastic food containers having tamper evident sealing mechanisms.

BACKGROUND OF THE INVENTION

It is known to use plastic containers in the food preparation and restaurant industry to package prepared foods. The typical food container of the prior art consists of a clear or solid colored base and a clear lid. In order to maintain the quality of food contents and prevent tampering with the contents of a sealed container, it is desirable that the food container, once initially sealed, not be capable of being initially opened without visible indication of the container having been opened. To achieve this feature, container manufacturers have designed containers having integral tamper evident features. Typically, these containers consist of a lid that is hingedly attached to a base. The lid seals to the base by superposing the rim of the lid upon the rim of the base. These types of plastic containers are sold as one-piece containers and are often referred to as "clamshell" containers or packages.

In one type of hinged tamper evident container the lid and base each have interlocking elements respectively located on or near the lid rim and base rim where the two rims meet when the container is sealed (i.e., at a non-hinged side or portion of the container). The interlocking element of the lid or base is conventionally located on a tab or flange extending from the rim of the lid or base. Either or both of the tabs are attached to their respective rims by a frangible section of plastic. When the lid and base are placed in initial sealing arrangement, the interlocking elements on or near the lid rim and base rim engage and lock together. In order to open the initially sealed container, the frangible section of one or both tabs must be ruptured so as to release the tab or tabs from the container. Because the interlocking sealing elements are located on the tabs, rupturing one or more tabs from the container disables the locking mechanism. The ruptured tab provides evidence of the container having been opened.

One shortcoming with the prior art food container described above is that the interlocked tabs can be cut from the container in clean fashion using scissors or another cutting implement so as to remove any indicia of the container having had a tamper evident mechanism.

In view of the issues presented by incorporating a tamper evident mechanism in the meeting rims of the hinged container, some manufacturers have incorporated tamper evident features as part of the structure that forms or includes the hinge. In these containers, the container is designed to require a severance near the hinge in order to unseal (initially open) the container. This construct make the hinge a single use hinge. These containers typically employ a square-shaped hinge arrangement (as seen from the side when the container is closed) in which the flange of the lid rim extends beyond the lid rim and then near-perpendicularly connects to a vertical segment that descends down from the lid flange. The vertical segment meets an extended portion of the base flange in similar near-perpendicular arrangement. The two flanges generally run parallel to each other and by their connection to the vertical segment form three sides of a square.

One example of a container with a square-shaped tamper evident hinge structure is shown in U.S. Pat. No. 7,073,680 (Boback, et al.). As can be seen in this patent, at the container's hinge area, the flange of the lid rim is vertically spaced above the flange of the base rim. A span of material (equal to the vertical spacing) adjoins to and descends from one end to the flange of the lid rim. The other end of the span of material adjoins to and ascends from the flange of the base rim. The span of material thus forms a strip of material connecting the lid rim flange and the base rim flange and operates to form hinge structure for the container. The lines of connection between the strip and the flanges are scored or include serial perforations such that the strip is a frangible section that can be torn away from the container after it is first sealed. With this type of tamper evident arrangement, one is left with a separate tear strip that must be disposed of and likely will not be recycled with the bulk of the container.

Another example of a clamshell container utilizing a square-shaped tamper evident hinge formation is shown in U.S. Published Patent Application No. 20120181280 (Barbier, et al). This reference discloses a hinge structure that is adapted to break by application of a squeeze force that causes the relative movement of two-adjacent sides (the top flange and the vertical span of material) that form the hinge arrangement.

Square-shaped hinge containers suffer from a variety of deficits. One is a tendency of the container not to remain fully open for purposes of filling the container. The memory of the square hinge mechanism is such that the lid tends to flop over and cover all or part of the base. Another deficit, at least as far as the Barbier container is concerned, is that the squeezing action required must move two adjacent, near perpendicular sides of the hinge structure and therefore the entire hinge structure must be effectively crushed in order to break the frangible line located at the bottom outside corner of the hinge structure. Thus, as is seen from the drawings in that published application, in order to rupture the frangible line, a squeezing force is applied to the entire box structure of the hinge area. This extended crushing motion may require the container to be stabilized with one's other hand in order to entirely rupture the frangible section. There is thus a need in the art for a re-closable plastic food container that is easy for end consumers to operate; combines reliable tamper evidence and defense against prying intrusion; and that uses a minimum of material to manufacture.

SUMMARY OF THE INVENTION

The present invention satisfies the needs in the art and provides an aesthetically appealing food container that is tamper resistant, tamper evident and easy to use. In this respect the present invention food container comprises a plastic food container that, when viewed from the left or right side, hinges about a frangible vertex instead of hinging about a square-shaped structure. Unlike in the case of containers with square-shaped hinge structures, the frangible vertex projects peripherally out from the container in horizontal alignment with the flanges of the lid rim and base rim. Hence, rather than crushing upon itself, the hinge-forming structure moves through empty space when pinched. When viewing the closed container from the rear side aspect (facing the hinge), the hinge is a scored, thinned or perforated line that represents the point where structure projecting from the lid and base flanges meet to form the hinge. Thus, as opposed to the prior art containers with square-shaped hinge structures, the container of the instant invention eliminates the vertical span at the hinge end by having the structures that extend from the flanges converge to form a hinge vertex.

There are several embodiments to the invention, which are broadly described in this summary section and more specifically described in the detailed description of the invention. In all embodiments the invention is directed to a tamper evident container having a lid and base hingedly attached to each other and capable of assuming an open arrangement, an initially sealed arrangement and an unsealed (opened) arrangement. The lid includes a cover surface and a lid rim. The inventive container includes a frangible hinge. The hinge is formed between a top pinch segment that peripherally projects from the lid rim flange and a bottom pinch segment that peripherally projects from the base rim flange. The frangible hinge is configured to rupture when the container is in the initially sealed arrangement by the application of a pinching force to the top pinch segment and bottom pinch segment that results in the relative vertical movement of the segments toward each other. In an alternate embodiment, the lid rim also includes a lid rim bead that includes an outer wall. The base of the alternate embodiment container includes a base rim that includes a base rim bead. The base rim bead includes an undercut inner wall that is configured to receive and frictionally engage the outer wall of the lid rim bead when the container is closed, whether in the initially sealed arrangement or when re-closed after opening.

In another embodiment the frangible hinge of the inventive container is connected to a top pinch segment that peripherally projects from the lid rim flange and a bottom pinch segment that peripherally projects from the base rim flange. When the container is in the initially sealed arrangement the top pinch segment and the bottom pinch segment have a vertical separation distance between them that extends between a first point on the top pinch segment and a second point on the bottom pinch segment. The frangible hinge is configured to rupture when the vertical separation distance is reduced which can occur by virtue of a pinching force applied to both pinch segments.

In another embodiment the frangible hinge of the inventive container is connected to a top pinch segment that peripherally projects from the lid rim flange and a bottom pinch segment that peripherally projects from the base rim flange. The top pinch segment includes a top vertex-forming segment and the bottom pinch segment includes a bottom vertex-forming segment. In the initially sealed configuration, the top vertex-forming segment and the bottom vertex-forming segment converge to form a vertex at their meeting point. The vertex is the container's hinge. As is further described herein, the top pinch segment may include a top pinch bead and the bottom pinch segment may include a bottom pinch bead. The pinch beads provide added rigidity to the pinch segments, which enhances the frangibility of the vertex hinge. Additionally, the pinch beads allow for more vertical movement during application of a pinching force, thus serving to ensure rupture of the frangible line. Also, the pinch beads designate a location at which a user can position his or her fingers to apply pinch force.

DETAILED DESCRIPTION

Figure 6:
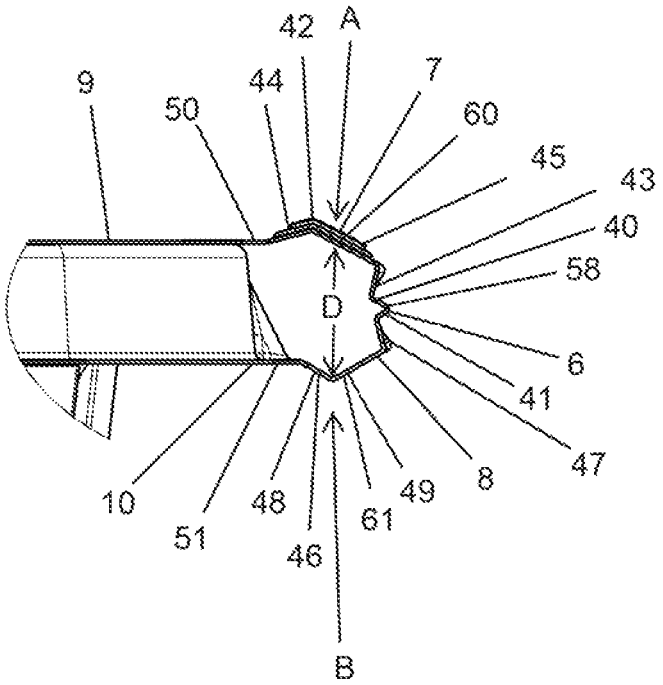
FIG. 6 is a detail view of the hinge area structure of the container in the initially sealed arrangement.
Figure 7:
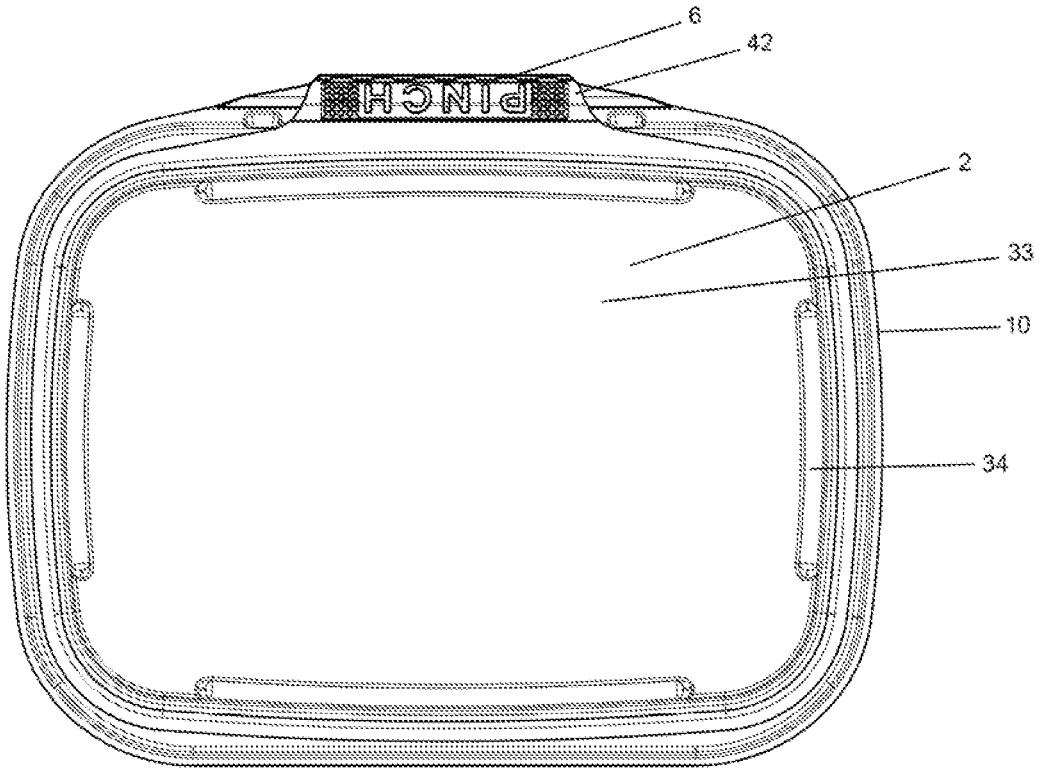
FIG. 7 is a top plan view of the preferred embodiment container in the initially sealed arrangement.

FIGS. 1-15 depict a preferred embodiment present invention tamper evident plastic container 1 along with its preferred features. As is seen in the figures, the inventive container 1 includes a lid 2 and a base 3 that are attached to each other through a hinge 6 located on one side of the container. In practical use, the outer surface of floor 26 of base 3 will normally rest upon a surface (such as a table top) considered horizontal in reference to the user. Thus, the directional terms "vertical" and "horizontal" and the like are used to describe the container 1 and its components with respect to the orientation illustrated in FIGS. 1-15 and are employed merely for the purposes of clarity and illustration. For example, FIG. 6 shows the hinge area of container 1 when container 1 is in an initially sealed state. In the orientation shown in FIG. 6, at the point where top pinch segment 7 connects to lid rim flange 9, top pinch segment 7 is spaced "vertically" above bottom pinch segment 8. The directional terms "inner" and "inwardly" and the like are used herein with respect to the described container to refer to directions along the directional component toward the geometric center of the container. The directional terms "outer," "peripherally" and the like are used herein with respect to the described container to refer to directions along the directional component away from the geometric center of the container. Additionally, the terms "upward," "downward" and the like are used to describe spatial relationships among structure when lid 2 of container 1 is sealed or closed upon the base 3.

As shown in the figures, lid 2 and base 3 respectively include lid rim 4 and a base rim 5. Lid rim 4 includes peripherally projecting lid rim flange 9. Base rim 5 similarly includes base rim flange 10. Unlike other tamper evident containers that use a square-shaped, multi-segmented hinge structure, hinge 6 of the present invention container is confined to a vertex 30 that is vertically situated at a position interposed between the height of the lid rim flange and the height of the base rim flange. (In the case of the Boback container, the frangible lines are at the same height as the flange structures emanating from the rims. In the Barbier container, the frangible line is actually below the height of the flange structure emanating from the base rim.) Further, as can be particularly seen in FIG. 6, the interposed frangible vertex projects horizontally and peripherally out from the container in alignment with the flanges of the lid rim and base rim.

Figure 8:
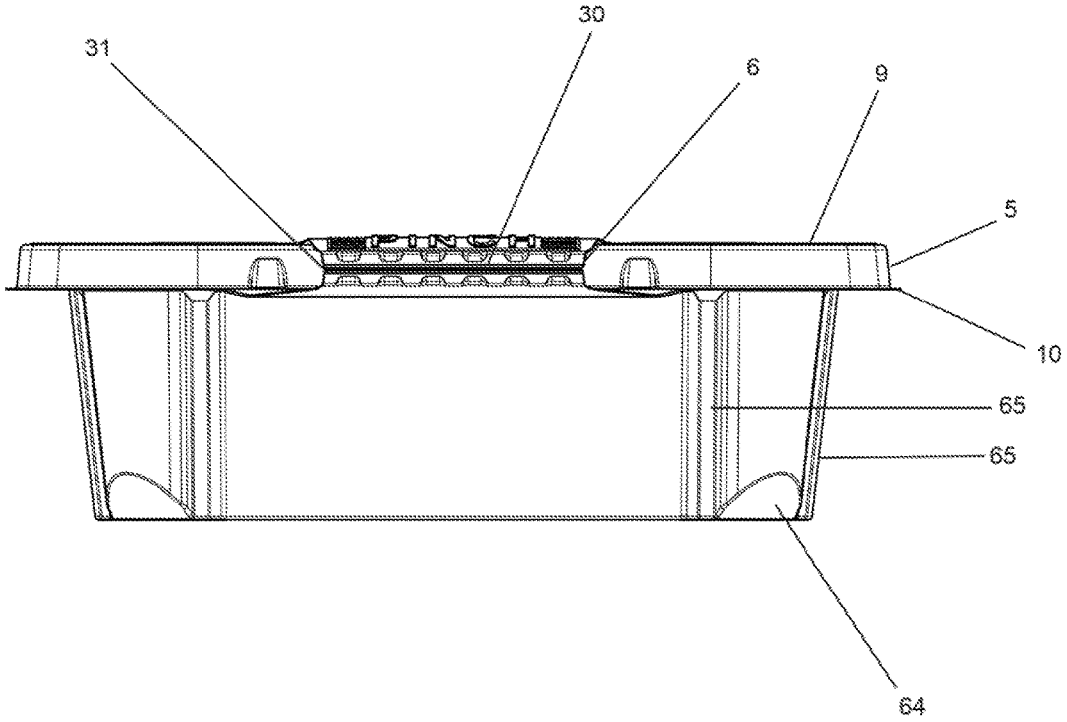
FIG. 8 is a rear elevation view of the preferred embodiment container in the initially sealed arrangement.
Figure 9:
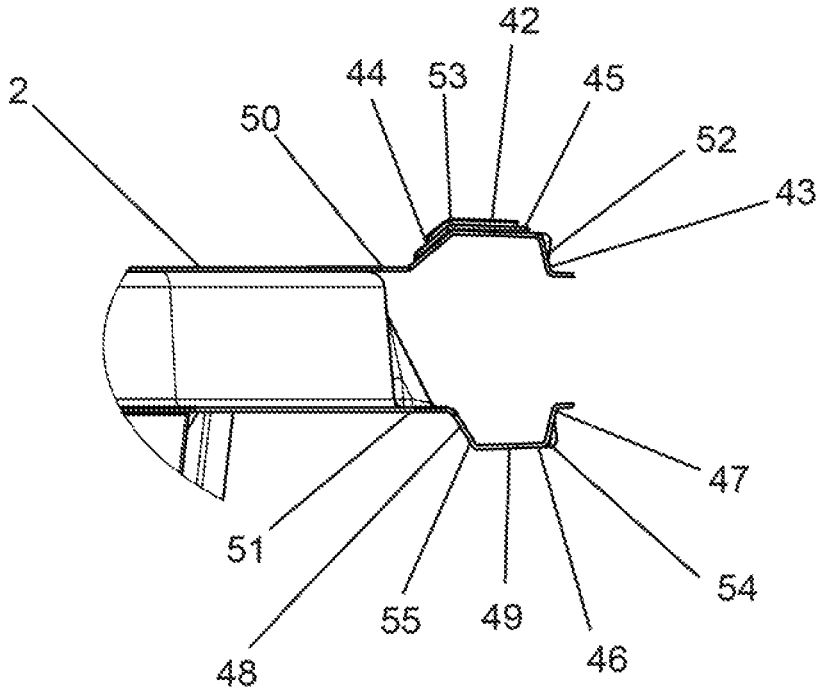
FIG. 9 is a detail view of the hinge area structure shown in FIG. 6, showing the rupture of the hinge as a result of pinching the top and bottom pinch segments.
Figure 10:
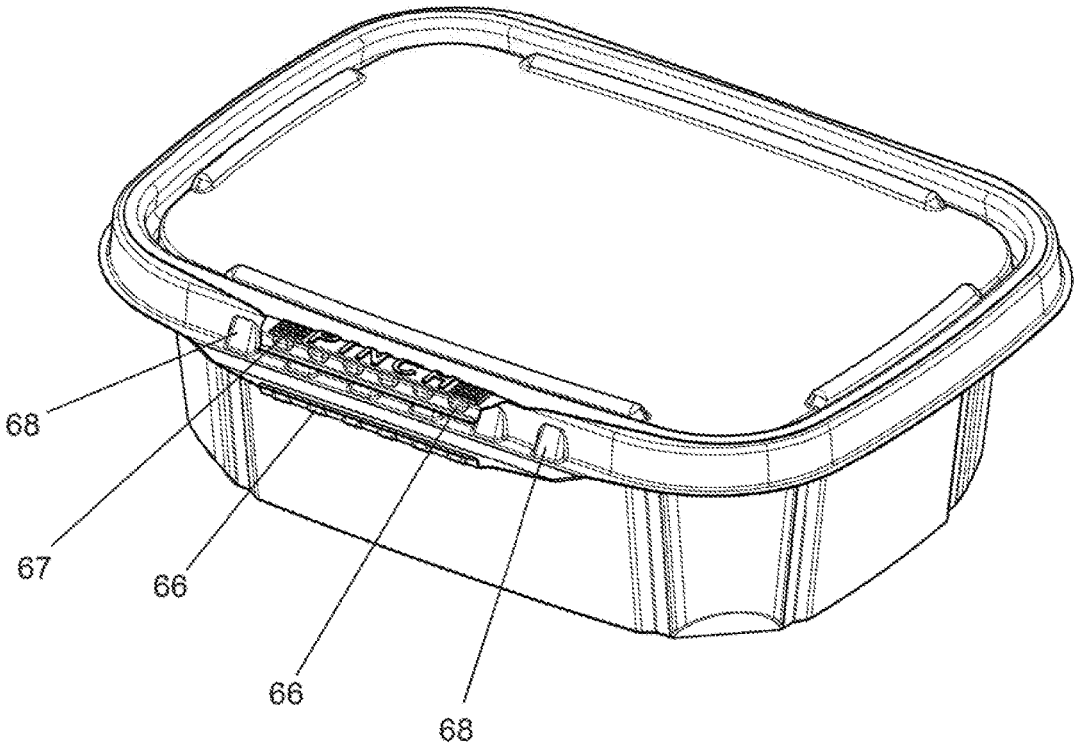
FIG. 10 is a rear perspective view of a preferred embodiment container showing the increased vertical separation between the top and bottom pinch segments after rupturing of the hinge, the increased vertical separation being due to the memory of the plastic in the container flanges and pinch segments.
Figure 11:
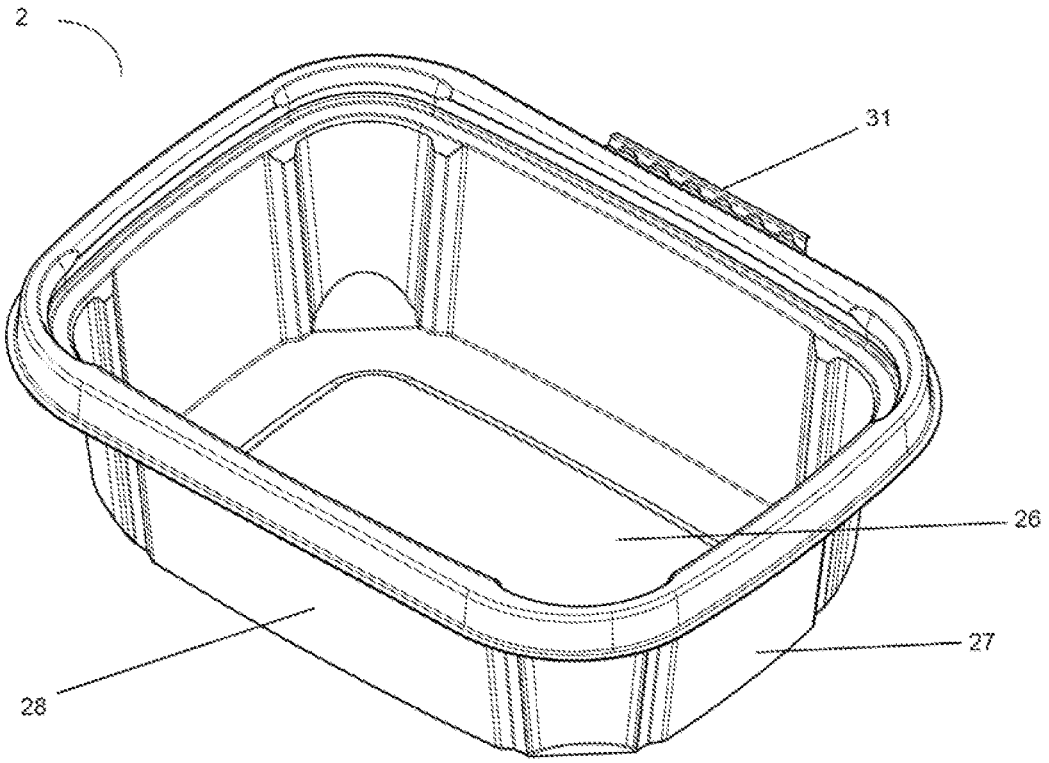
FIG. 11 is a front perspective view of the base of the preferred embodiment plastic container after the initially sealed container has been opened.
Figure 12:
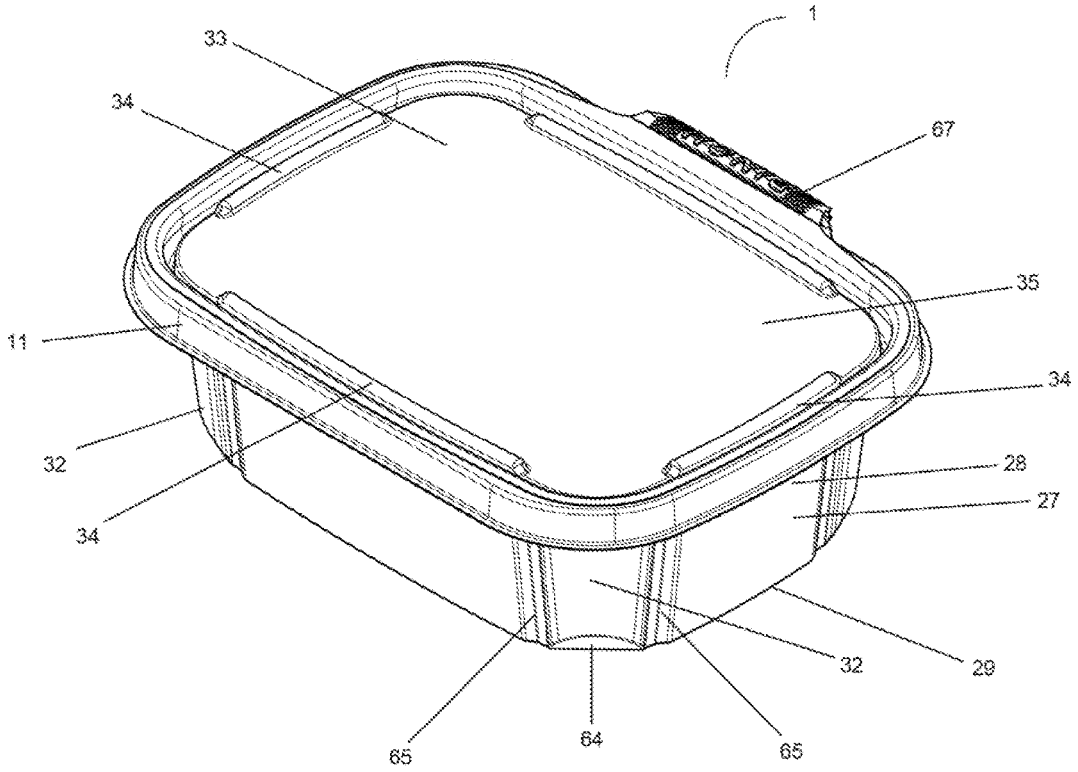
FIG. 12 is a front perspective view of an embodiment of the present invention plastic container in the initially sealed state.
Figure 13:
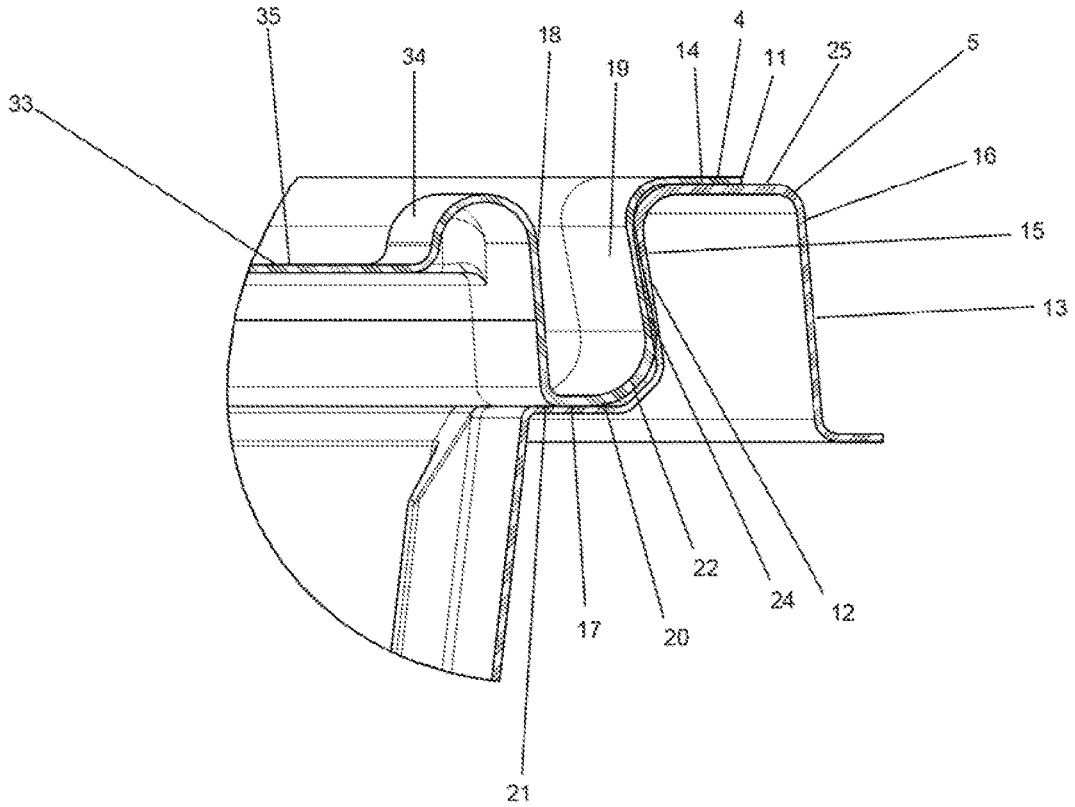
FIG. 13 is a view of a cross-section of the engaged rims of the container.

As shown in the figures, preferred embodiment container 1 is capable of assuming an open arrangement (FIGS. 1-3, 14), an initially sealed arrangement (FIGS. 4-8, 12, 15) and an opened arrangement (FIGS. 9-11). Additionally, container 1, after being opened from the initially sealed state can be closed (re-sealed). The first embodiment container comprises lid 2 and base 3. Lid 2 includes cover portion 33 and lid rim 4. Lid rim 4 circumferentially extends about the periphery of lid 2. FIG. 13 depicts preferred embodiment rim structural features that make the embodiment container not just tamper evident, but also tamper resistant. In the preferred embodiment, lid rim 4 includes lid rim bead 17 that comprises a downwardly descending lid rim inner vertical wall 18, an upwardly extending lid rim outer wall 19 and a bead bottom segment 20. Bead bottom segment 20 extends from the bottom 21 of lid rim inner wall 18 and curves into the bottom 22 of the lid rim outer wall 19. Base 3 includes base rim 5 circumferentially extending about the periphery of base 3. Base rim 5 includes base rim bead 11 that comprises upwardly extending inner vertical wall 12, downwardly extending outer wall 13 and bead top segment 14. Bead top segment 14 extends from top 15 of upwardly extending inner vertical wall 12 to top 16 of the downwardly extending outer wall 13. Downwardly extending inner wall 12 includes undercut surface 24 configured to receive and frictionally engage outer wall 19 of lid rim 4 when container 1 is in the sealed or closed arrangement.

As is best shown in FIGS. 6-9, at the hinge area of container 1, lid rim flange 9 extends out and connects to top pinch segment 7. In the same area, base rim flange 10 extends out and connects to bottom pinch segment 8. As can be readily seen, when container 1 is in the initially sealed arrangement, top and bottom pinch segments 7, 8 project out respectively from flanges 9, 10 and converge to form vertex 30. Frangible vertex 30 projects peripherally out from the container in horizontal alignment with the flanges of the lid rim and base rim. Hinge 6 is defined by vertex 30 and is the point about which lid 2 and base 3 articulate for initially sealing and closing of the container.

Hinge 6 is formed between top pinch segment 7 that peripherally projects from lid rim flange 9 and bottom pinch segment 8 that peripherally projects from base rim flange 10. Frangible hinge 6 is configured to rupture when container 1 is in the first sealed arrangement by the application of a pinching force to top pinch segment 7 and bottom pinch segment 8 that results in the relative vertical movement of segments 7, 8 toward each other. The action of the hinge and container-opening technique is best seen in FIGS. 6-10.

Figure 1:
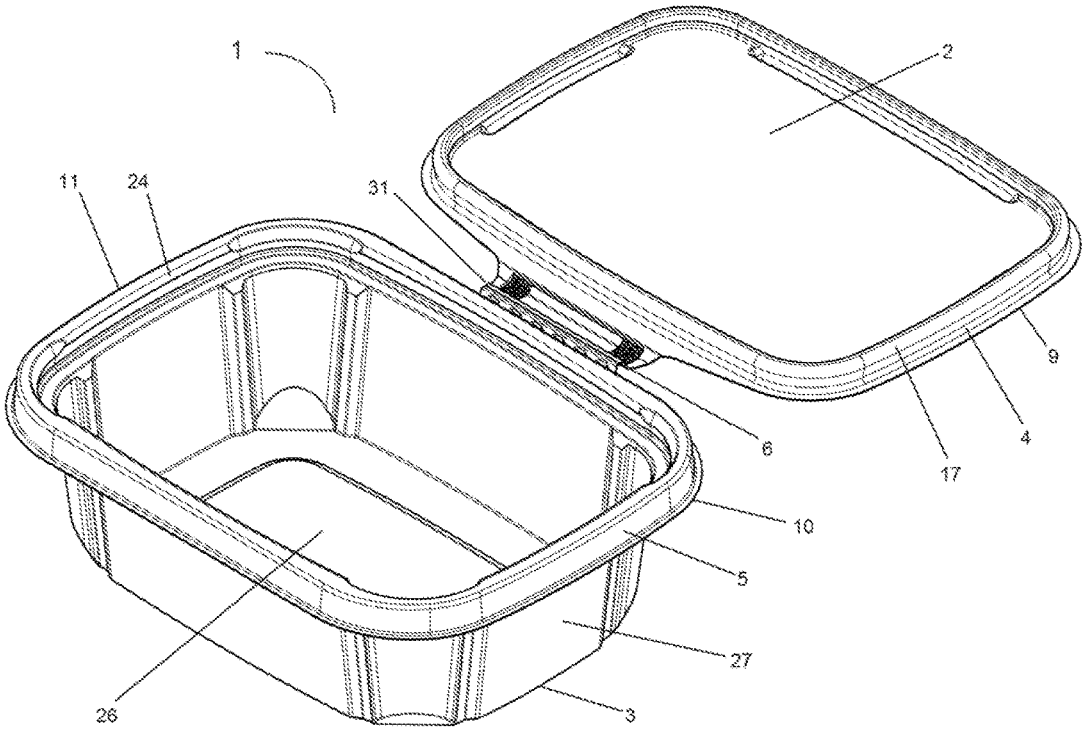
FIG. 1 is a front perspective view of a preferred embodiment of the present invention plastic container in the open arrangement, ready to be filled.
Figure 2:
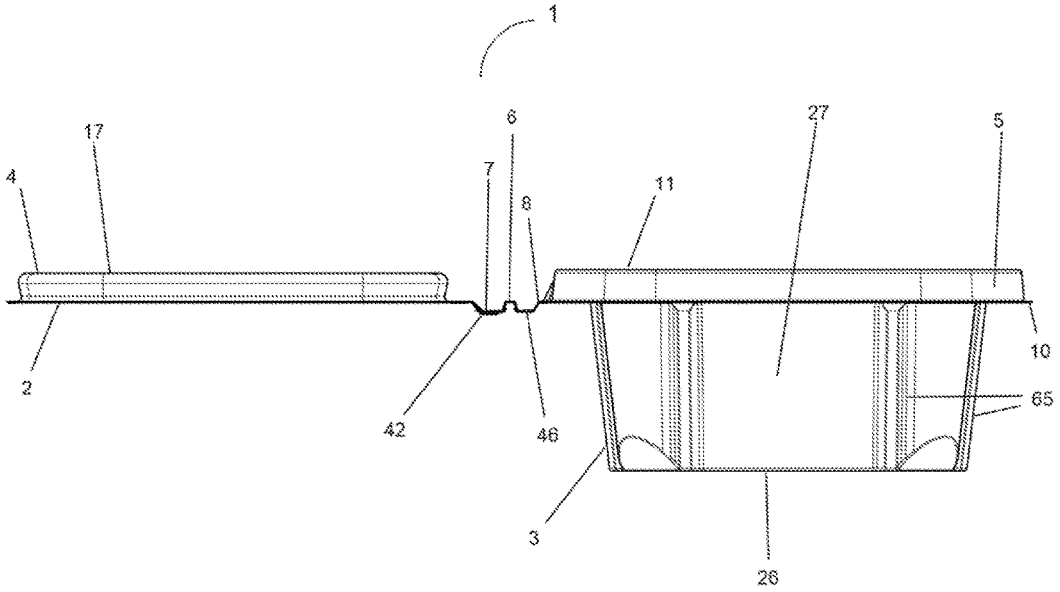
FIG. 2 is a left elevation view of the preferred embodiment container in the open arrangement.
Figure 3:
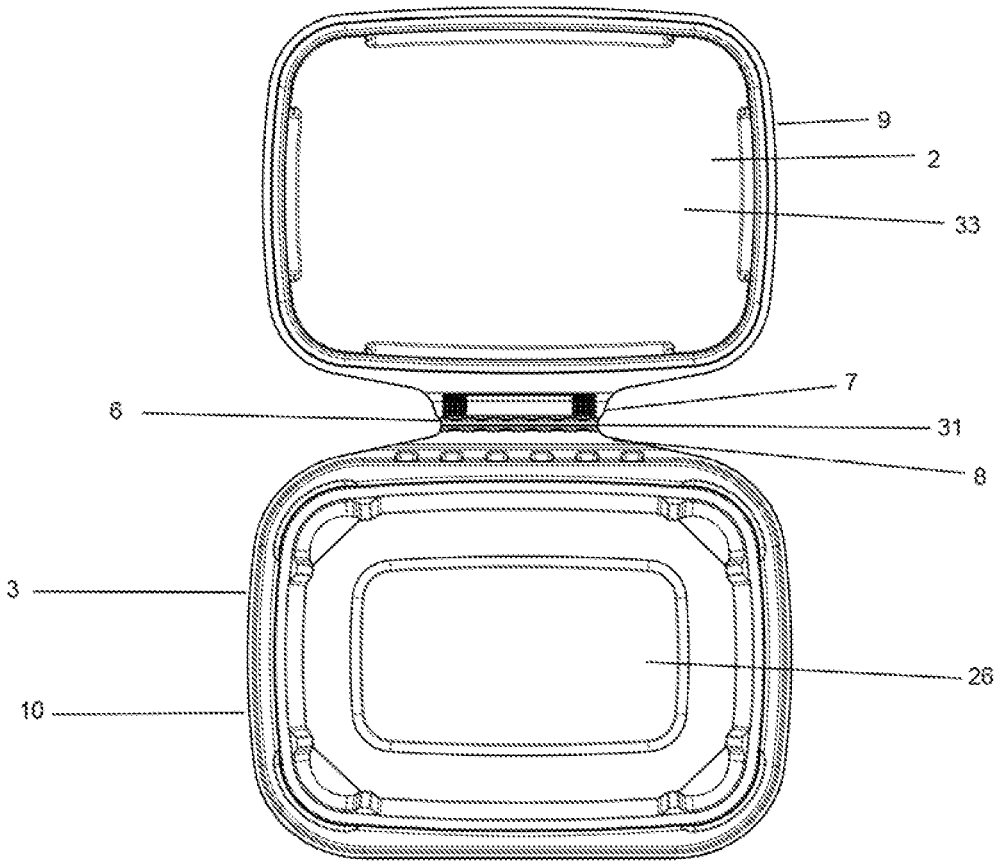
FIG. 3 is a top plan view of the preferred embodiment container in the open arrangement.
Figure 4:
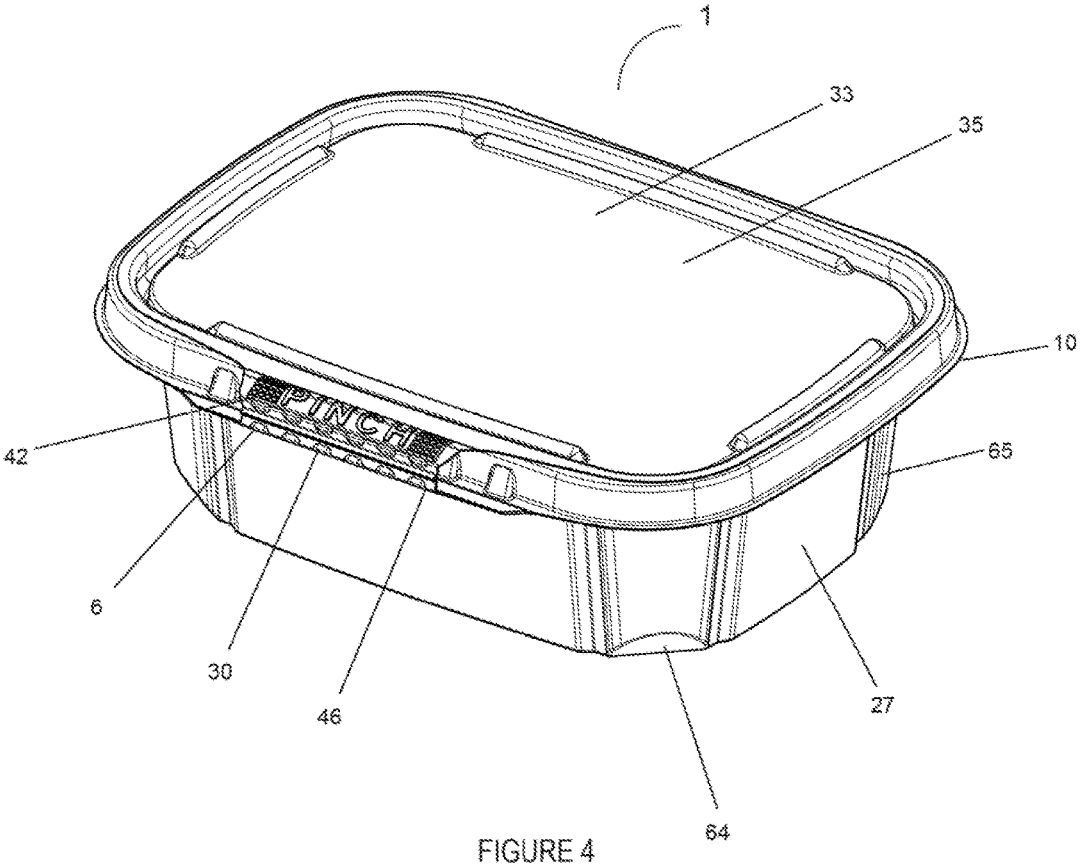
FIG. 4 is a rear perspective view of a preferred embodiment of the present invention plastic container in the initially sealed arrangement.
Figure 5:
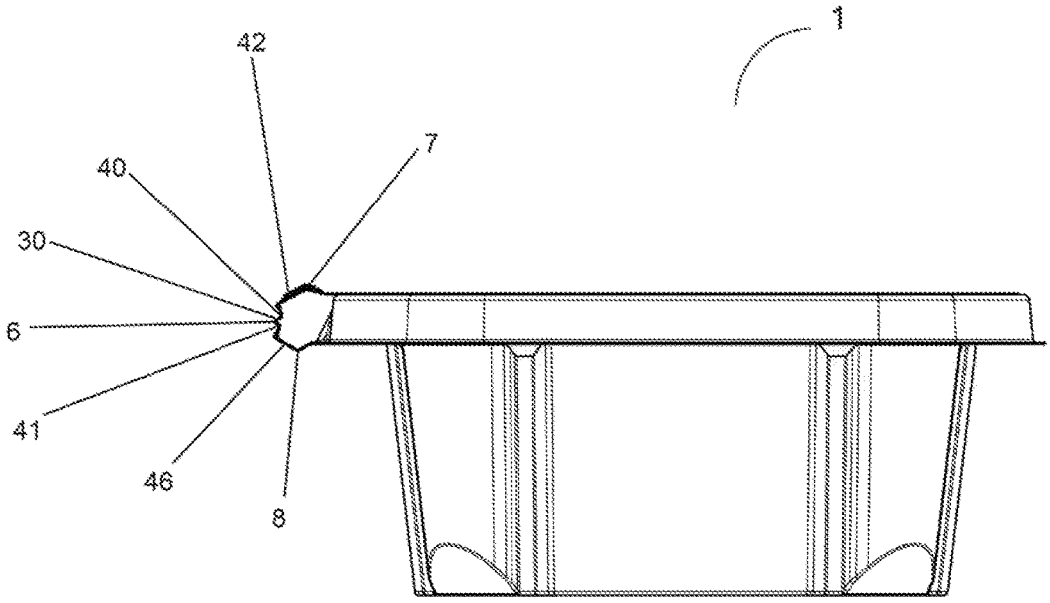
FIG. 5 is a left elevation view of the preferred embodiment container in the initially sealed arrangement.

Hinge 6 is frangible and its length can be seen best in FIGS. 1, 3, and 8. Container 1 is preferably thermoformed from a single sheet of plastic. Hinge 6 is manufactured by thinning, scoring or making perforations in a line 31 across the segment of material that joins lid 2 to base 3. Frangible line 31 can be best seen in FIG. 14, but also can be seen in FIGS. 1, 3 and 8. The remnant frangible line 31 can be seen in FIG. 11. The process of thinning, scoring or perforating serves to concentrate the point of articulation during closing of the container at the vertex and not on other sections of the container. Also, the process of thinning, scoring and perforating operates to make hinge 6 frangible and determines the amount of pinch force needed to rupture hinge 6. The material connecting hinge 6 to lid rim flange 9 forms top pinch segment 7. The material connecting hinge 6 to base rim flange 10 forms bottom pinch segment 8.

The geometric relationship of the hinge area structures and the action of opening the container can be described in more particular fashion. As shown best in FIG. 6, when container 1 is in the initially sealed state pinch segments 7, 8 are vertically separated from each other at all points along their length except at vertex 30. Hinge 6, and thus, vertex 30 are therefore vertically located between pinch segments 7, 8 when the container is in the initially sealed arrangement. Point 60 represents a first point on top pinch segment 7. Point 61 represents a second point on bottom pinch segment 8. When a pinching force (shown by arrows A, B) is applied to pinch segments 7, 8 as shown in FIG. 6, the vertical distance D between points 60 and 61 on segments 7, 8 is reduced and top pinch segment 7 is pulled away from bottom pinch segment 8 at vertex 30. This pulling action causes hinge 6 located at vertex 30 to rupture and end point 58 of top pinch segment 7 to slide upon and down bottom pinch segment 8 toward container 1. As shown in FIG. 9, once the pinching force is released, pinching segments 7, 8 spring apart vertically due to the action of the memory in the plastic material forming pinching segments 7, 8 and flanges 9, 10. It can be seen in FIG. 10 that separated pinching segments 7, 8 can be pulled apart and used to peel open lid 2 from base 3.

In the preferred embodiment, top pinch segment 7 includes a top vertex-forming segment 40 and bottom pinch segment 8 includes bottom vertex-forming segment 41. Hinge 6 is thus a vertex formed by the convergence of top hinge point-forming segment 40 and bottom hinge point-forming segment 41. In an alternate embodiment, either or both of lid rim 3 and base rim 4 could lack their respective flanges 9, 10 around the sides and front of container 1, in which case pinch segments 7, 8 would respectively connect to lid rim 3 and base rim 4 at the rear (hinge area) of the container.

As best shown in FIGS. 4, 6, 7 and 8-10, top pinch segment 7 may include a top pinch bead 42. Similarly, bottom pinch segment 8 may include a bottom pinch bead 46. Pinch beads 42, 46 are desirably formed as follows. As displayed in FIG. 9, top pinch bead 42 may comprise a first sidewall 43, a second sidewall 44 and a top finger rest segment 45 extending between a top 52 of first sidewall 43 and a top 53 of second sidewall 44. It is preferable that bottom pinch bead 46 also comprise a first sidewall 47, a second sidewall 48 and a bottom finger rest segment 49 extending between a bottom 54 of first sidewall 47 and a bottom 55 of second sidewall 48.

Figure 14:
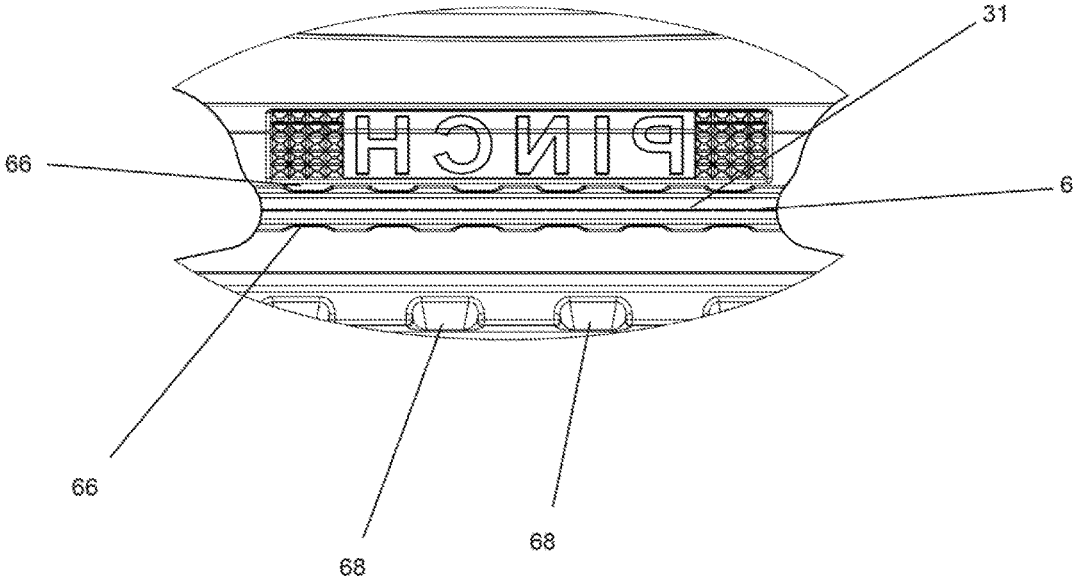
FIG. 14 is a top plan detail view of the hinge of a preferred embodiment container in the open arrangement.
Figure 15:
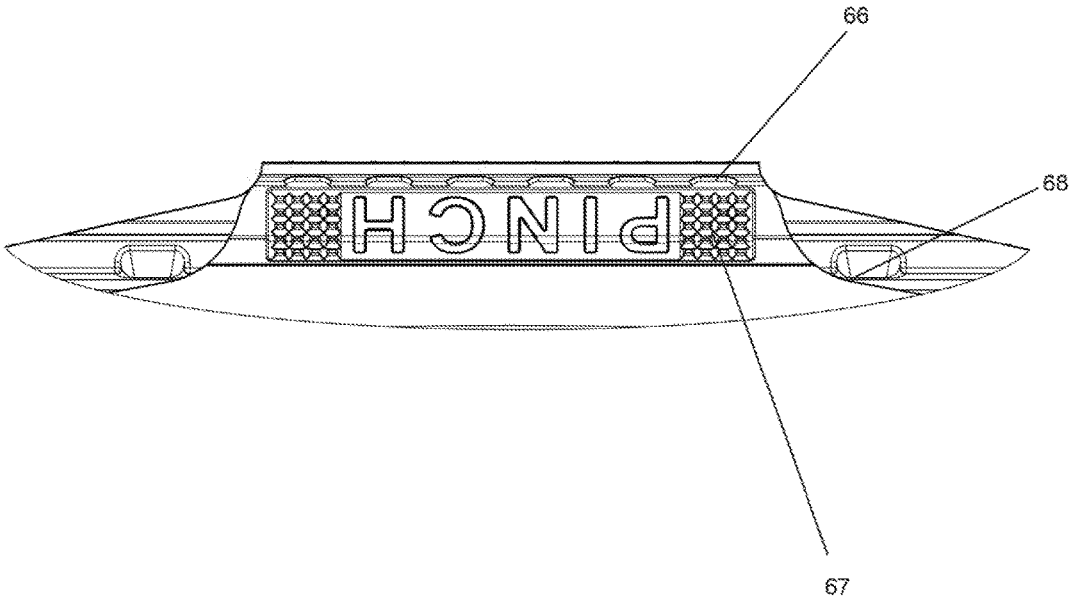
FIG. 15 is a top plan detail view of the hinge of a preferred embodiment container in the initially sealed arrangement.

In a preferred embodiment top finger rest segment 45 is substantially perpendicular (80-100 degrees) to first sidewall 43 of top pinch bead 42. It is also preferable that bottom finger rest segment 49 be substantially perpendicular to first sidewall 47 of the bottom pinch bead 46. As shown in the figures, second sidewall 44 and top finger rest segment 45 include a textured surface or knurling 67 so as to enhance purchase on top pinch segment 7 during pinching action. Additionally, as best seen in FIGS. 10, 14 and 15 the rim and pinch segment structures may include formed or impressed pinch segment lugs 66 and rim lugs 68 to add rigidity in the hinge area so that the hinge more readily breaks when pinched.

Top pinch segment 7 further preferably includes transition segment 50 that extends between top pinch bead 42 and lid rim flange 9. More optimally, top pinch segment 7 includes a transition segment 50 that extends between second sidewall 44 of the shown embodiment top pinch bead 42 and lid rim flange 9. For optimal operation of the hinge breaking mechanism, bottom pinch segment 8 may also include a transition segment 51 that extends between bottom pinch bead 46 and base rim flange 10. In the particular embodiment shown, bottom pinch segment 8 includes a transition segment 51 that extends between second sidewall 48 of bottom pinch bead 46 and base rim flange 10. Top segment finger rest 45 is preferably longer than either first sidewall 43 or second sidewall 44 of top pinch bead 42.

To thwart prying into the container without rupturing hinge 6, base rim 5 may include rim bead 11 described above and shown in FIG. 13. When container 1 is in the sealed arrangement lid rim flange 9 assumes a position above or on top of the top surface 25 of top segment 14 of base rim bead 11. As the figures also show, lid rim 4 is structured such that it includes lid rim flange 9 connected to lid rim outer wall 19. Lid rim outer wall 19 is of such height that lid rim flange 9 is positioned higher than cover portion 33 of lid 2. As an added tamper resistance feature against prying or grasping of the lid rim, cover portion 33 includes one or more elongate cover beads 34 protruding upward from the outer surface 35 of cover portion 33. Bead 34 is optimally positioned 5 millimeters or less from lid rim outer wall 19 to prevent grasping of lid rim flange 9.

As shown by the figures, the container can be polygonal with beveled corners at its floor. The inclusion of beveled corners also enhances the security of the container by reducing the chance of the container cracking open or developing holes should it be dropped. In this particular version container 1 has a base 3 that comprises floor 26 and a plurality of sidewalls 27. Each sidewall 27 has a top 28 and bottom 29. The bottom 29 of each sidewall 27 is connected to floor 26. The plurality of sidewalls 27 form a polygon in which each sidewall 27 extends between and connects to two other sidewalls 27. Each connection between sidewalls 27 forms a corner 32. Each corner 32 includes a bevel 64 that is connected to floor 26 and the sidewalls 27 that form that corner 32. In the shown embodiment, container 1 can include flutes 65 on sidewall 27 that add strength to the container and define the width of bevel 64.

A container constructed in accordance with the present invention can be manufactured in a variety of shapes and sizes, and is preferably formed of resins or plastic materials including, but not limited to, polyethylene, polypropylene, polyvinyl chloride or polyethylene terephthalate ("PET"). The container is preferably thermoformed, but can be blow-molded or injection molded. The container lid and base can be transparent or translucent, and may be colored in either instance. Further, the container is preferably polygonal so as to include the described bevels 64, but can be of any shape.

Having described the invention in detail, those skilled in the art will appreciate that modifications may be made of the invention without departing from its spirit. Therefore, it is not intended that the scope of the invention be limited to the specific embodiment illustrated and described.

What is claimed is:

1. A tamper evident container capable of assuming an open arrangement and an initially sealed arrangement, the container comprising:

a lid and a base;

the lid including a cover surface and a lid rim;

the lid rim including a lid rim bead and a lid rim flange;

the base including a base rim;

the base rim including a base rim bead and a base rim flange;

a frangible hinge, the hinge formed between a top vertex forming segment of a top pinch segment, the top pinch segment peripherally projecting from a length of the lid rim flange and a bottom vertex forming segment of a bottom pinch segment, the bottom pinch segment peripherally projecting from a length of the base rim flange;

the top vertex forming segment and bottom vertex forming segment converging at the frangible hinge, the converging segments creating a projection in horizontal alignment with the lid rim flange and the base rim flange, the top pinch segment including a top pinch bead having a sidewall projecting upwardly from the lid flange;

the bottom pinch segment including a bottom pinch bead having a sidewall projecting downwardly from the base rim flange; and the frangible hinge rupturing when the container is in the initially sealed arrangement by the application of a pinching force to the top pinch segment and bottom pinch segment that results in the relative vertical movement of the segments toward each other.

2. The container of claim 1 wherein:

the base rim bead includes a downwardly extending base rim outer wall having a bottom; and the base rim flange horizontally projects from the bottom of the downwardly extending base rim outer wall.

3. The container of claim 2 wherein:

the lid rim bead includes a downwardly descending lid rim inner vertical wall, an upwardly extending lid rim outer wall and a bead bottom segment; and the upwardly extending lid rim outer wall has a top and the lid rim flange horizontally projects from the top of the upwardly extending lid rim outer wall.

4. The container of claim 1 wherein:

the lid rim bead includes a downwardly descending lid rim inner vertical wall, an upwardly extending lid rim outer wall and a bead bottom segment; and the upwardly extending lid rim outer wall has a top and the lid rim flange horizontally projects from the top of the upwardly extending lid rim outer wall.

5. The container of claim 4 wherein the upwardly extending lid rim outer wall is of such height that the lid rim flange is positioned higher than the cover surface of the lid when the container is in the initially sealed arrangement.

6. The container of claim 5 wherein when the container is in the initially sealed arrangement: the frangible hinge is vertically situated at a position interposed between the height of the lid rim flange and the height of the base rim flange.

7. The container of claim 1 wherein after the hinge ruptures the top pinch segment and bottom pinch segment spring apart vertically.

* * * * *